US007150175B2

(12) United States Patent
Traub

(10) Patent No.: US 7,150,175 B2
(45) Date of Patent: Dec. 19, 2006

(54) CLAMP ASSEMBLY FOR BEND ARM OF TUBE BENDING MACHINE

(75) Inventor: Zeno P. Traub, Vista, CA (US)

(73) Assignee: Eaton Leonard Robolix, Inc., Vista, CA (US)

( * ) Notice: Subject to any disclaimer, the term of this patent is extended or adjusted under 35 U.S.C. 154(b) by 149 days.

(21) Appl. No.: 10/714,368

(22) Filed: Nov. 14, 2003

(65) Prior Publication Data

US 2005/0103078 A1 May 19, 2005

(51) Int. Cl.
*B21D 7/02* (2006.01)

(52) U.S. Cl. ..... 72/159; 72/149

(58) Field of Classification Search ..... 72/156, 72/155, 159, 153, 149, 310, 422; 269/32, 269/233

See application file for complete search history.

(56) References Cited

U.S. PATENT DOCUMENTS

| | | | | | |
|---|---|---|---|---|---|
| 4,063,441 | A | * | 12/1977 | Eaton | 72/151 |
| 4,750,346 | A | | 6/1988 | Traub | 72/149 |
| 4,760,726 | A | * | 8/1988 | Traub | 72/149 |
| 4,938,047 | A | | 7/1990 | Yogo et al. | 72/149 |
| 5,617,753 | A | * | 4/1997 | Glissman et al. | 72/149 |
| 5,687,601 | A | | 11/1997 | Caporusso et al. | 72/149 |
| 5,918,496 | A | * | 7/1999 | Hopf | 72/159 |
| 6,009,737 | A | | 1/2000 | Bandy | 72/150 |
| 6,155,091 | A | | 12/2000 | Hayes et al. | 72/150 |
| 6,192,728 | B1 | | 2/2001 | Hu et al. | 72/149 |
| 2002/0174700 | A1 | | 11/2002 | Meliga | |

* cited by examiner

*Primary Examiner*—Lowell A. Larson
*Assistant Examiner*—Debra Wolfe
(74) *Attorney, Agent, or Firm*—Knobbe Martens Olson Bear LLP

(57) ABSTRACT

A clamping assembly for use with a bend arm of a tube bending machine. The assembly comprises a force multiplier linkage that applies a controlled and variable force to a workpiece. In one embodiment, the force multiplier linkage comprises a bearing member pivoted by an actuator acting on one end of a force multiplier arm that is attached to the bearing member. A pivot member supporting a drive link is fixedly attached to the bearing member at a location offset from the bearing member's pivot axis. The drive link pivots about the pivot member axis so that in cooperation with additional links it moves a bend arm slider. The drive link also pivots about the bearing member axis. As the bearing member is pivoted about its axis by the force multiplier arm, the drive link also pivots about the bearing member's axis providing the required force for application to the workpiece.

43 Claims, 17 Drawing Sheets

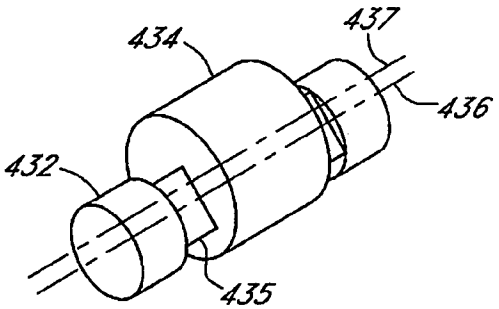
FIG. 19
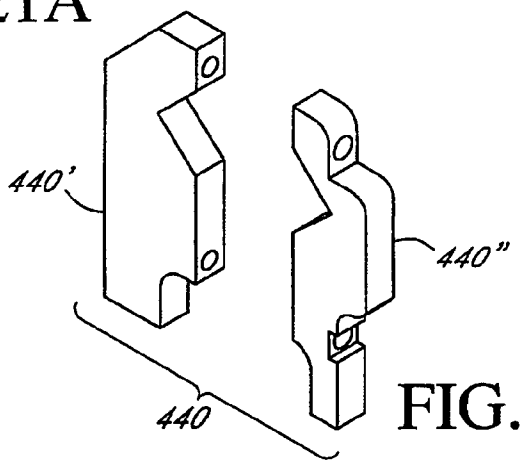
FIG. 21A
FIG. 21B
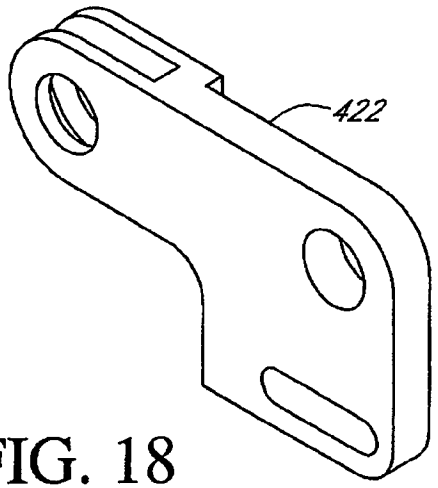
FIG. 18
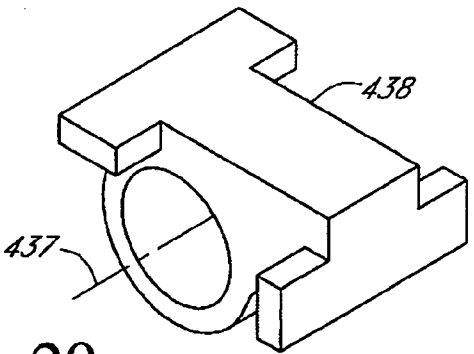
FIG. 20

CLAMP ASSEMBLY FOR BEND ARM OF TUBE BENDING MACHINE

BACKGROUND OF THE INVENTION

1. Field of the Invention

This invention relates generally to tube bending machines. More particularly, the invention relates to an automatic clamping assembly for a bend arm of a tube bending machine.

2. Description of the Related Technology

In order to accomplish the bending of pipes or tubes in a mass production environment, automated pipe or tube bending machines have been developed. The workpiece to be bent may be of relatively large diameter, such as an automobile or truck exhaust pipe, or may be of relatively small diameter, such as a tube for a hydraulic or pneumatic apparatus.

A tube bending machine ("bender") usually forms a series of pre-programmed bends in a length of tube. A bender typically has a fixed, elongated machine bed configured to support and advance a workpiece to a tube bending zone (the "bend head") at one end of the machine bed. The workpiece is fed, such as from a length of tubing or a coil, through a rotatable chuck or collect gripping arrangement to the bend head. Typically, the bend head includes a rotary bend die having a concave groove corresponding to a radius of the diameter of the workpiece to be bent. The tube is fed toward the bend head until the tube is positioned at the bend die at the location to be bent. A bend arm assembly then positions a clamp die, which has a concave groove corresponding to the concave groove of the bend die, into abutting relation with the tube at the bend point. In one common type of machine, force is then applied to the clamp die to physically restrain the tube at the bend die. Rotation of the bend and clamp dies, with the tube clamped between them, bends the tube around the bend die.

The clamp die is typically coupled to a moving slide which moves in and out between closed and open positions of the clamp-bend-dies pair. In one configuration, the clamp die is mounted on a linkage mechanism which drops away, below the centerline height of the bend die, into a cavity of the bend arm when in an open position to clear the tube after bending. The clamp die is usually positioned with a hydraulic cylinder which operates at a single pressure. A limit switch indicates when the clamp die is fully closed. This system usually involves the coupling of the clamp die holder on a toggle mechanism, which means that the applied pressure cannot be varied and is relatively difficult to predict. This configuration results in a substantial disadvantage since application of excessive force results in scoring or crimping of the tube, while application of insufficient force results in slippage of the tube during pivoting of the clamp and bend dies. Either event may result in an unusable tube section.

Therefore, there is a need in the industry for a tube bending machine having a clamping assembly that provides a controllable and variable clamping force. The invention disclosed below provides various mechanisms and methods that address this need.

SUMMARY OF THE INVENTION

The system and methods of the present invention have several aspects, no single one of which is solely responsible for its desirable attributes. Without limiting the scope of this invention as expressed by the claims which follow, its more prominent features will now be discussed briefly.

One embodiment of the invention concerns a clamping assembly for a bend arm of a tube bending machine. The clamping assembly comprises a bend arm slider having a first end and a second end, wherein the slider first end is configured to receive a clamp die. The slider couples to a guide member configured to move along an arcuate surface of a camming member, which camming member couples to the bend arm. The clamping assembly can also include a first lever having a first end and a second end; the first lever has a pivot axis and couples to a first pivot member, wherein the first pivot member couples to the bend arm. The first end of the first lever couples to the slider's second end and is configured to drive the slider along the arcuate surface. The clamping assembly may further include a toggle link having a first end and a second end. The first end of the toggle link couples to the first lever second end, and the toggle link is configured to rotate the first lever about the first lever pivot axis. The clamping assembly of this embodiment can also have a drive link that has a first end and a second end, wherein the drive link first end couples to the toggle link second end and the drive link is configured to drive the toggle link. The clamping assembly can also include a second pivot member that couples to the drive link such that the drive link pivots about a second pivot member axis.

In some embodiments, the clamping assembly can further include a bearing member that couples to the bend arm and has a bearing axis, wherein the bearing member couples to the second pivot member at a location offset from the bearing member axis. The clamping assembly can also comprise an actuator that couples to the drive link second end and is configured to rotate the drive link about the second pivot member axis such that a force is communicated from the actuator through the drive link, the toggle link, and the first lever to thereby cause the slider to retract or extend along the arcuate surface in response to the force. In some embodiments, the clamping assembly can further include a second lever having a first end and a second end. The second lever first end pivotally couples to the bearing member and fixedly attaches to the second pivot member. In one embodiment, the clamping assembly is configured such that the actuator couples to the second lever second end and is configured to actuate the second lever so as to rotate the bearing member about the bearing axis. This configuration communicates a force via the drive link, the toggle link, and the first lever to the slider, resulting in the transmission of a controlled, variable force from the actuator to the clamp die.

Yet another embodiment of the invention relates to a leverage mechanism for use with a clamp die positioning linkage assembly. The leverage mechanism comprises a bearing member that has a bearing member axis. The leverage mechanism can also include a pivot member having a pivot member axis, wherein the pivot member fixedly attaches to the bearing member such that the bearing member axis and the pivot member axis are substantially parallel and offset relative to one another. In some embodiments, the lever mechanism further includes a bearing block that receives and supports the bearing member, wherein the bearing block is configured for attachment to a bend arm of a tube bending machine. The lever mechanism can also comprise a lever arm that couples to the bearing member for causing the bearing member to pivot about the bearing member axis.

In other embodiments the invention concerns a bend head for a tube bending machine. The bend head comprises a bend arm configured to cooperate with a rotary bend die for bending a workpiece. The bend head can further include a linkage assembly coupled to the bend arm for positioning a clamp die, the clamp die configured to grip the workpiece in cooperation with the bend die. The bend head can also comprise a bearing member having a bearing member axis. In some embodiments, the bend head includes a bearing block configured to support the bearing member and to be coupled to the bend arm, wherein the bearing member is configured to rotate about the bearing member axis inside a bore of the bearing block. The bend head can additionally include a pivot member attached to the bearing member at a location offset from the bearing member axis, and a lever configured to rotate the bearing member about the bearing member axis, a first end of the lever attachable to the bearing member.

Yet another embodiment of the invention relates to a method of positioning a clamp die and gripping a workpiece with the clamp die. The method comprises raising and extending a bend arm slider to position the clamp die at a location opposite to a rotary bend die, wherein the raising and extending is accomplished in part by a linkage assembly comprising at least one linkage member. The method further comprises applying a first force to the linkage member via a lever mechanism such that a second force applied to the lever mechanism is less than the second force.

BRIEF DESCRIPTION OF THE DRAWINGS

The above and other aspects, features, and advantages of the invention will be better understood by referring to the following detailed description, which should be read in conjunction with the accompanying drawings, in which:

FIGS. 14–21B show perspective views of certain components of the clamping assembly illustrated in FIG. 4.

DETAILED DESCRIPTION OF CERTAIN INVENTIVE EMBODIMENTS

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the invention described here.

Generally, the invention described herein concerns clamping mechanisms for use with the bend arm of a tube bending machine. The clamping mechanisms and related methods of the invention allow the application of a controlled and variable force to a workpiece. Moreover, certain embodiments of the clamping assembly provide a compact assembly that permits convenient handling of the workpiece at the bend head of the tube bender.

Figure 1:
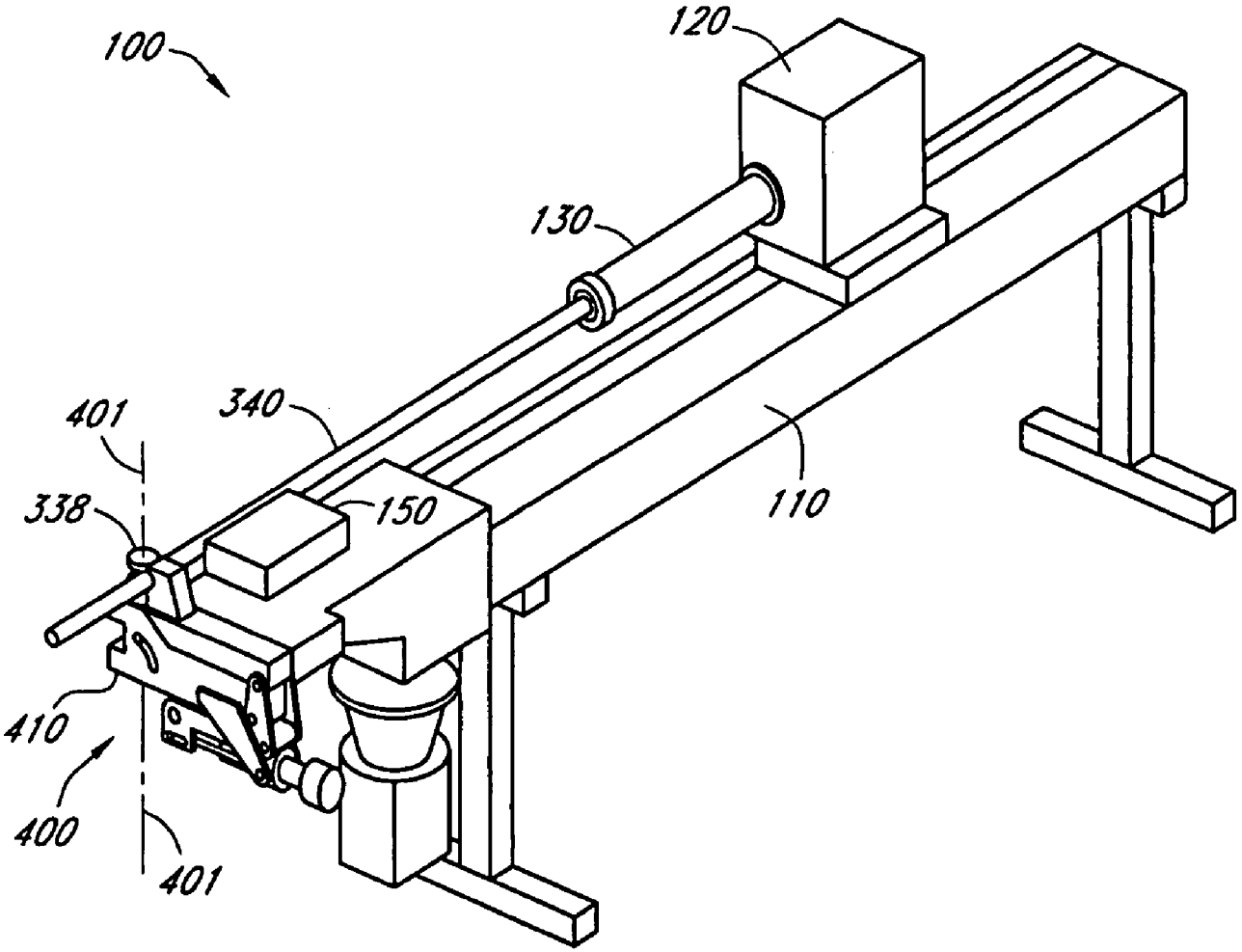
FIG. 1 is a perspective view of a tube bending machine having a bend arm with a clamping assembly as may be utilized in accordance with one embodiment of the invention.
Figure 2:
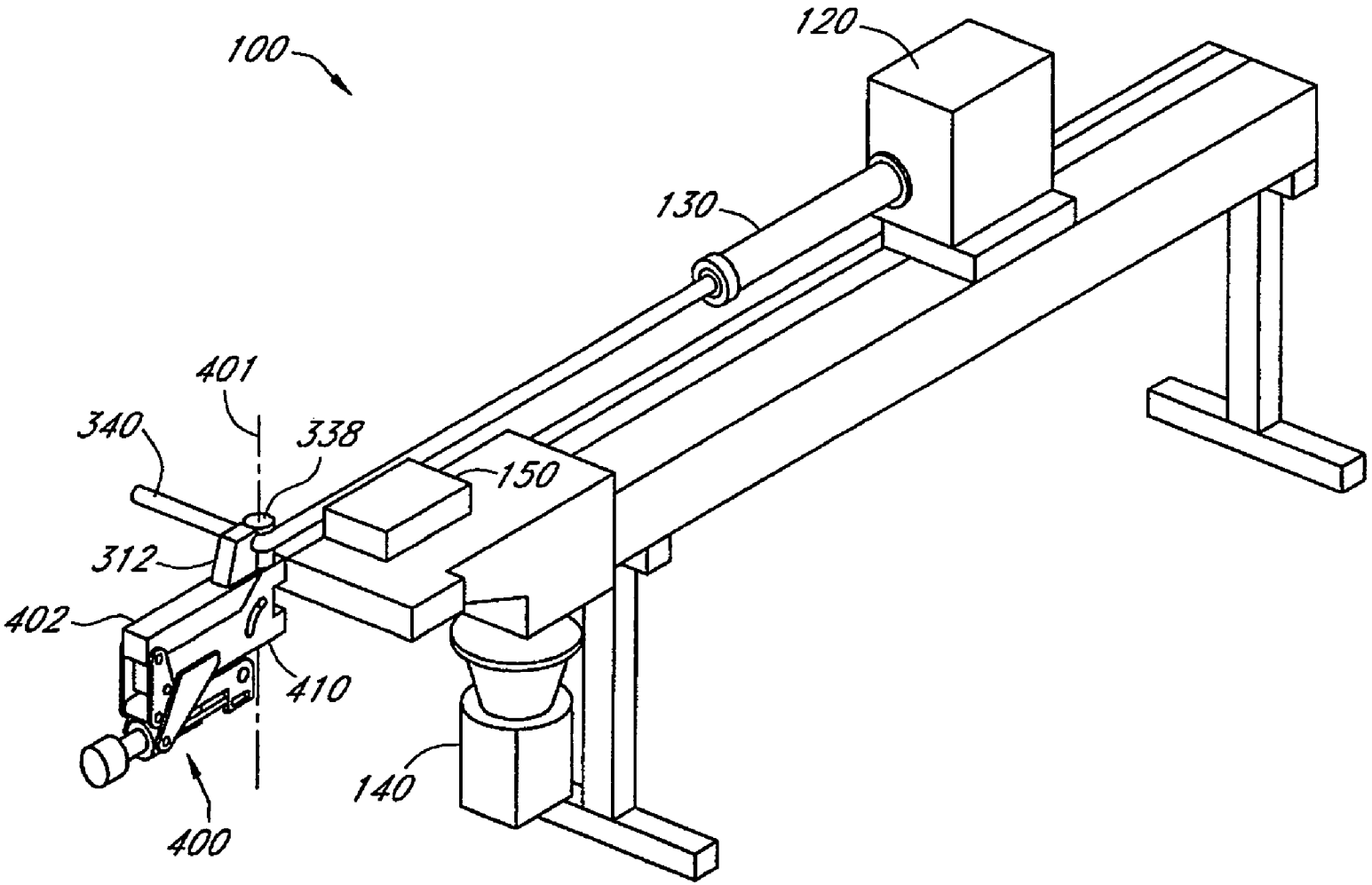
FIG. 2 is a perspective view of the tube bending machine shown in FIG. 1, wherein the bend arm is now shown in a rotated position as it bends a workpiece.

FIGS. 1 and 2 show a typical bending machine that can be configured to employ a bend arm having a clamping assembly in accordance with embodiments of the invention. FIG. 1 shows a tube bending machine 100 having a bend arm 410 configured with a clamping assembly 400, as will be further described below with reference to FIGS. 4 through 15. The bender 100 includes a bed 110 that supports a carriage assembly 120. A rotatable chuck 130 couples to the carriage assembly 120 and is configured to grip a workpiece such as a tube 340.

In operation, the carriage assembly 120 and chuck 130 cooperate to translate and rotate the workpiece 340 to place it at a desired bending location in a bending zone ("bend head"), which comprises a bend die 338 and a clamp die 312. The workpiece 340 is gripped by the bend die 338 and clamp die 312 as the bend arm 404 is rotated about an axis 401 of the bend die 338. An actuator 140 suitably coupled (not shown) to the bend arm 410 rotates the bend arm 410 about the axis 401. A restraint block 150 restrains the workpiece 340 at point between the bend head and the chuck 130. In the embodiment shown, the bender 100 has bent a portion of the workpiece 340 through a 90 degree angle.

Figure 9:
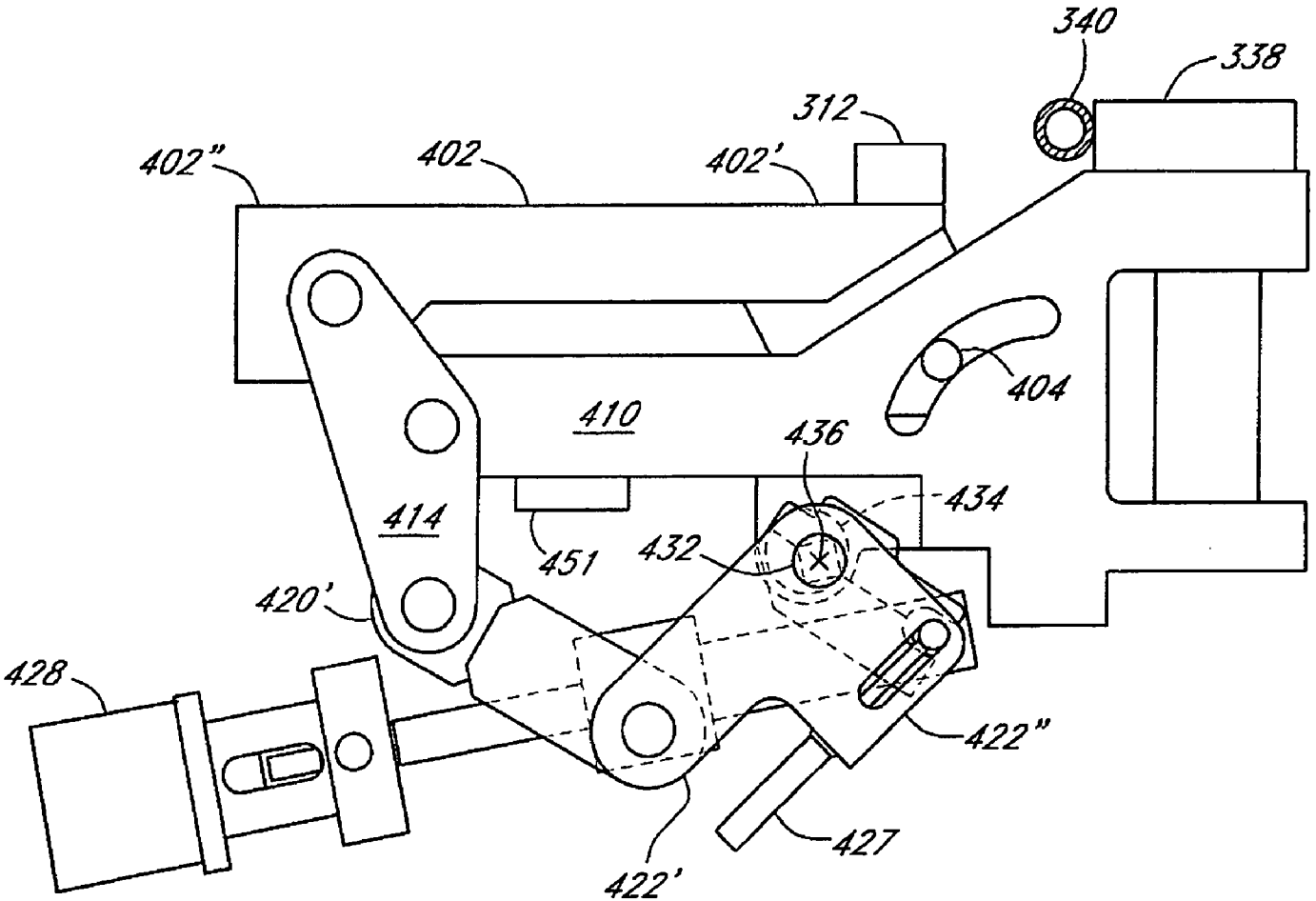
FIG. 9 is a side elevational view of the clamping assembly of FIG. 8, except that the linkage assembly is illustrated as having advanced further as the slider is raised and extended from its retracted and lowered position.
Figure 10:
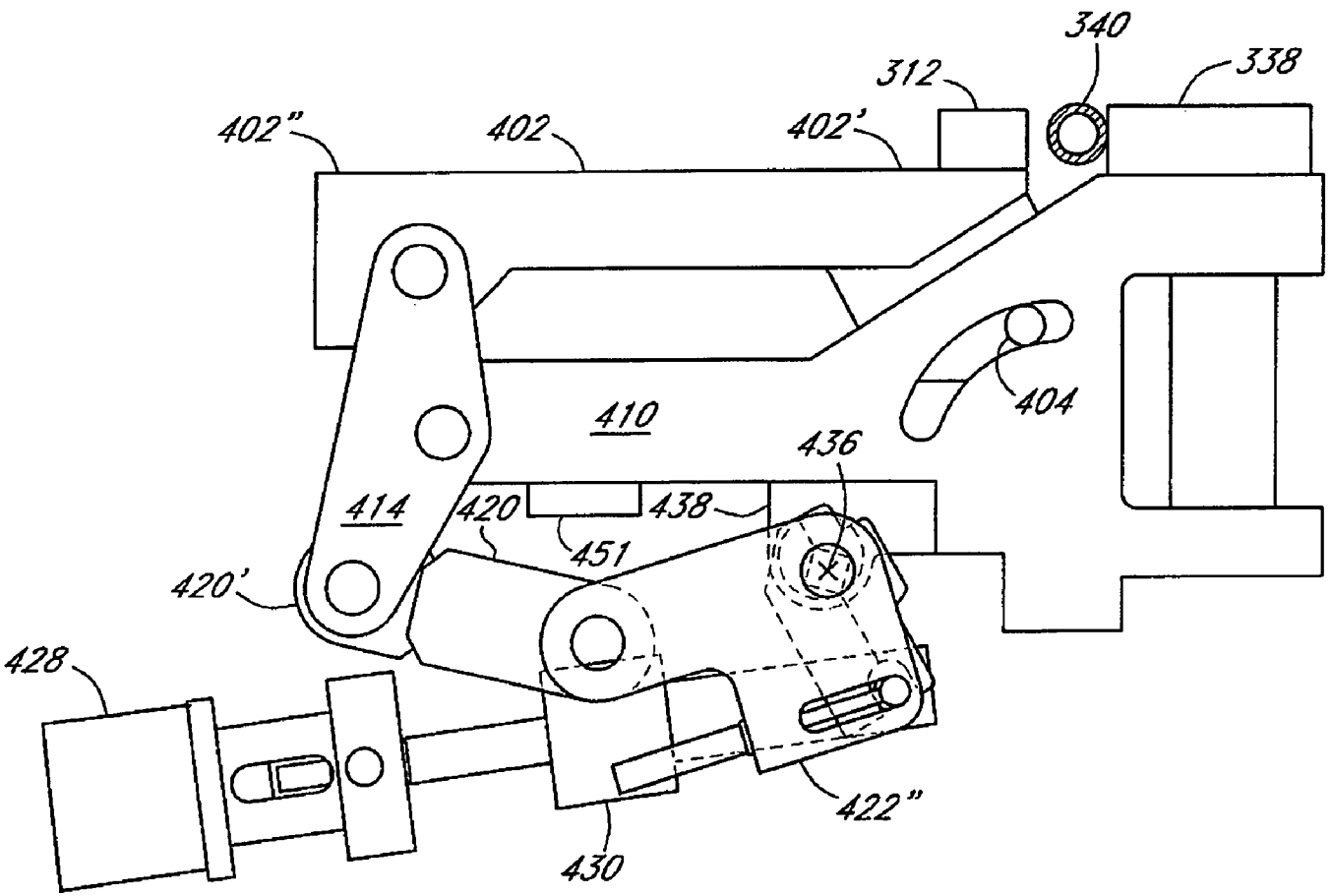
FIG. 10 is a side elevational view of the clamping assembly of FIG. 9, except that the linkage assembly is illustrated as having advanced further as the slider is raised and extended.
Figure 11:
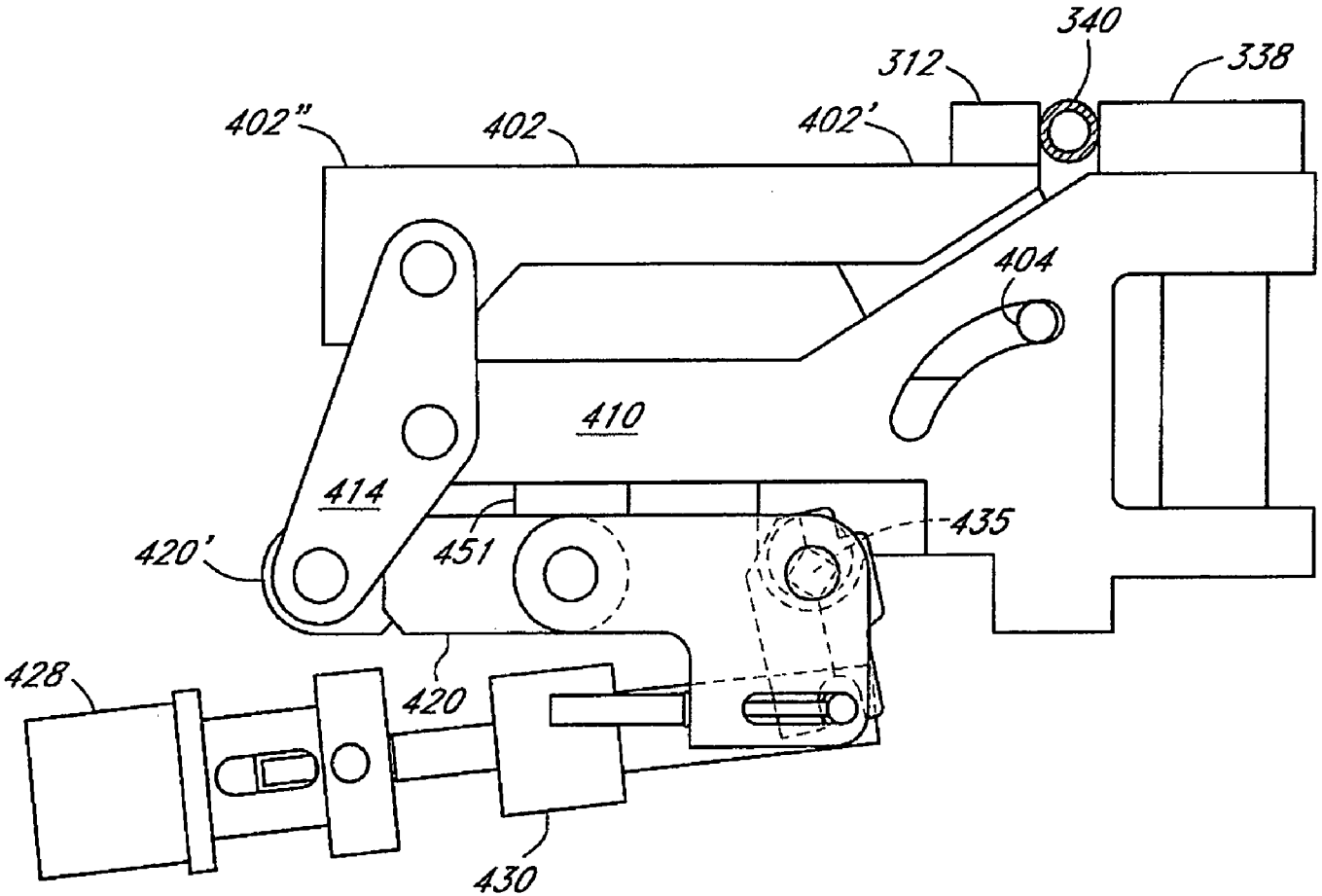
FIG. 11 is a side elevational view of the clamping assembly of FIG. 10, except that the linkage assembly is illustrated as having advanced to nearly the top of the movement that raises and extends the slider.

To perform a subsequent bend on the same workpiece 340, the clamp assembly 400 retracts and lowers a bend arm slider 402 relative to the bend die 338 (see FIGS. 9–11). Since the clamp die 312 is coupled to the slider 402, the clamp die 312 also retracts and falls away from the workpiece 340 and the bend die 338. The actuator 140 returns the bend arm 410 to the starting position shown in FIG. 1. Next, the carriage 120 and chuck 130 position the workpiece 340 at the new bend location. Then the clamping assembly raises and extends the slider 402 to engage the clamp die 312 against the workpiece 340. The actuator 140 rotates the bend arm 410, as previously described, to produce the new bend on the workpiece 340.

Figure 3A:
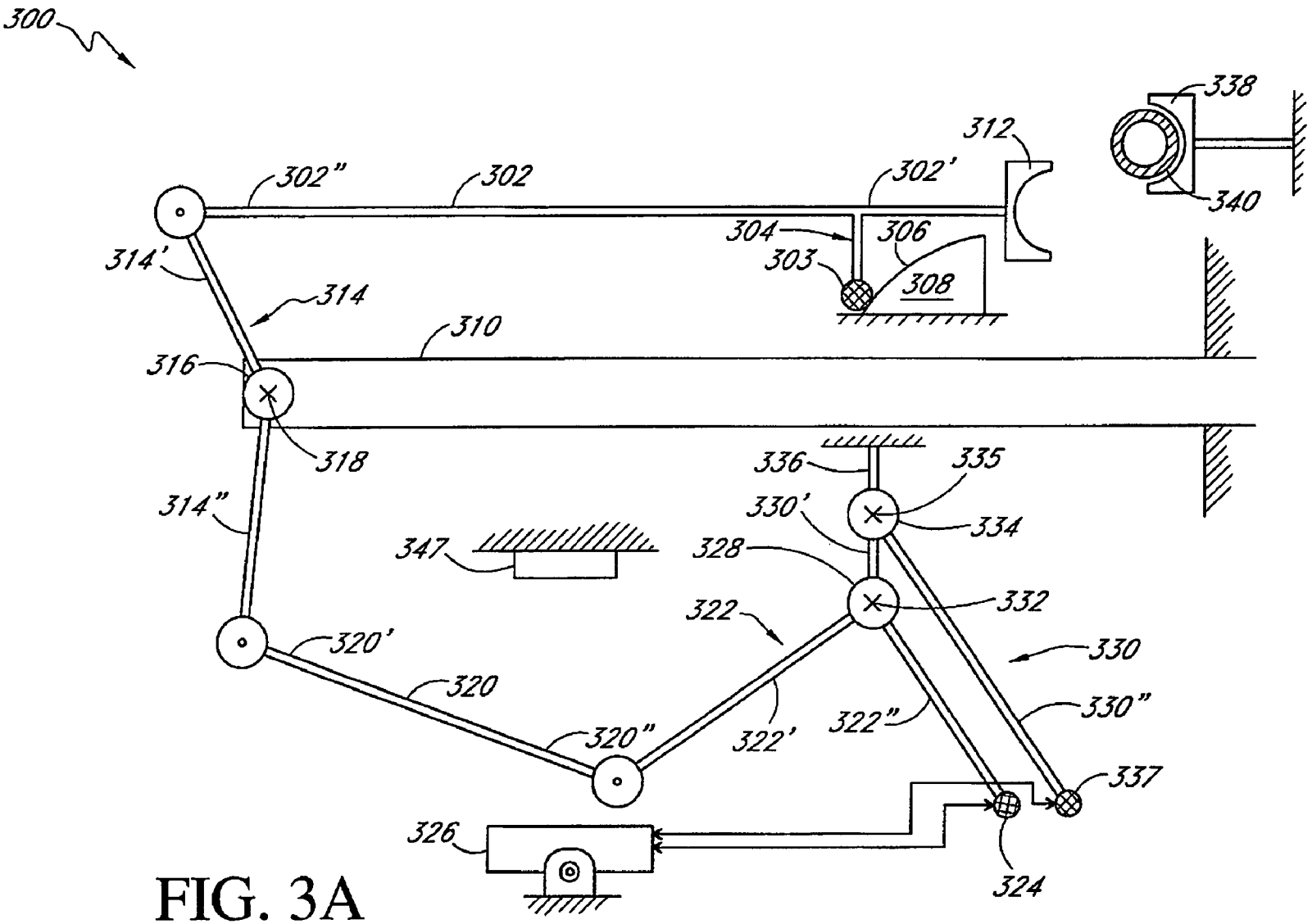
FIG. 3A is a schematic diagram of an exemplary clamping assembly in accordance with the invention. The clamping assembly is shown in its open position.

FIG. 3A is a schematic diagram of a clamping assembly 300 in accordance with one embodiment of the invention. The exemplary clamping assembly 300 includes a bend arm slider 302 having a first end 302' and a second end 302". The slider 302 couples to an end of a guide member 304. The guide member 304 extends downwardly from the slider 302 to a contact end 303. The contact end 303 is in contact with and moves along an arcuate surface 306, which can be provided by, for example, a camming member 308 coupled to the body of a bend arm 310. The slider first end 302' can be configured to receive a clamp die 312. The clamping assembly 300 includes a lever 314 having a first end or arm 314' and a second end or arm 314". The slider second end 302" pivotally couples to the lever's first end 314'. The lever's first end 314' and second end 314" are configured to pivot about a pivot member 316 coupled to a bend arm 310. An axis 318 characterizes the pivot member 316 and also defines the pivot axis of the lever 314.

A first end 320' of a toggle link 320 couples pivotally to the lever second end 314". A toggle second end 320" couples pivotally to a first end 322' of a drive link 322. As will be discussed further below, a stop member 347 (see FIG. 3B), which in one embodiment couples to the bend arm 310, provides a stop at the coupling between the toggle link 320 and the drive link 322. In one embodiment, a drive link second end 322" couples at a member 324 to an actuator 326. The drive link 322 couples pivotally to a pivot member 328, which is characterized by an axis 332. The clamping assembly 300 can include a lever 330 having a first end or arm 330' and a second end or arm 330". The pivot member 328 couples to the lever first end 330'. The lever 330 couples pivotally to a pivot member 334 that is supported on a support member 336. An axis 335 characterizes the pivot member 334. In one embodiment, the lever's second end 330" couples to the actuator 326 at a member 337.

In operation of the clamping assembly 300, starting at an open position (see FIG. 3A) in which the clamp die 312 is retracted and lowered relative to a bend die 338, the actuator 326 pivots the drive link 322 clockwise about the axis 332 of the pivot member 328. The drive link first end 322' acts upon the toggle second end 320", which results in a lifting of the toggle second end 320", as well as a simultaneous pivoting of the toggle second end 320" about the coupling of the toggle first end 320' and the lever second end 314".

The toggle first end 320' pushes against the lever second end 314" causing the lever 314 to pivot clockwise about the axis 318 of the pivot member 316. The lever first end 314' pushes against the slider second end 302" causing the slider 302 to rise and extend toward the bend die 338 as the guide member 304 rides up the arcuate surface 306. This movement continues until the toggle link 320 comes into collinear alignment with the drive link first end 322' and the stop member 347 prevents any further upward movement of the toggle 320 and drive link 322 at their coupling. At the end of the movement, as illustrated in FIG. 3B, the slider 302 brings the clamp die 312 into abutting engagement with a workpiece 340. Hence, the combined action of the drive link 322, toggle link 320, and lever 314 raises and extends the slider 302 from a retracted and lowered position as the actuator 326 acts to pivot the drive link 322 clockwise about the axis 332.

Once the slider 302 is raised and extended into engagement with the workpiece 340 (see FIG. 3B), the actuator 326 acts upon the lever second end 330" to apply a controlled and variable force by the clamp die 312 against the workpiece 340. The actuator 326 acts on the lever second end 330" causing the lever 330 to pivot about the axis 334. The pivoting of the lever 330 results in the lever first end 330' pushing the drive link 322 against the toggle link 320, which in turn presses against the lever second end 314". The lever 314 thus is forced to pivot about the axis 318, which results in the lever 314 pressing the slider 302 and clamp die 312 against the workpiece 340. In the embodiment shown, when the actuator 326 pushes the lever second end 330", the movement is reversed and the slider 302 releases the pressure on the workpiece 340.

To return the slider 302 from its raised and extended position to the retracted and lowered position, the actuator 326 can pivot the drive link 322 counterclockwise about the axis 332. The drive link first end 322' pushes the toggle second end 320" downward, and simultaneously the toggle first end 320' pivots about its coupling to the lever second end 314". The toggle first end 320' pulls on the lever second end 314" causing the lever 314 to pivot counterclockwise about the axis 318. As the lever first end 314' pivots about the axis 318, the lever first end 314' pulls the slider 302 away from the bend die 338. The slider 302 rides downward on the arcuate surface 306 with the aid of the contact member 303 and the guide member 304. Thus, the combined action of the drive link 322, toggle link 320, and lever 314 retracts and lowers the slider 302 from an extended and raised position as the actuator 326 acts to pivot the drive link 322 counterclockwise about the axis 332.

An advantage of the clamping assembly configuration 300 described above is that the force applied by the actuator 326, and transferred ultimately to the workpiece 340 by the linkage assembly consisting of the drive link 322, toggle link 320, lever 314, slider 302 and clamp die 312, is magnified by the use of the lever 330. This configuration corresponds to a first class lever (i.e., where the fulcrum is between the load and the effort). For convenience of description, the "effort arm" is the distance D1 between the pivot axis 335 and the line of action of the force that the actuator 326 applies to the member 337 at the lever second end 330". The "load arm" is the distance D2 between the pivot axis 335 and the pivot axis 332. The magnification is substantially equal to the ratio of the effort arm to the load arm, namely D1:D2.

Figure 3C:
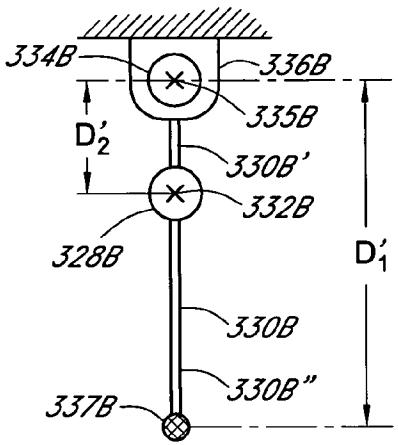
FIG. 3C is a schematic diagram of another linkage arrangement that can be employed with the clamping assembly shown in FIG. 3B.
Figure 3B:
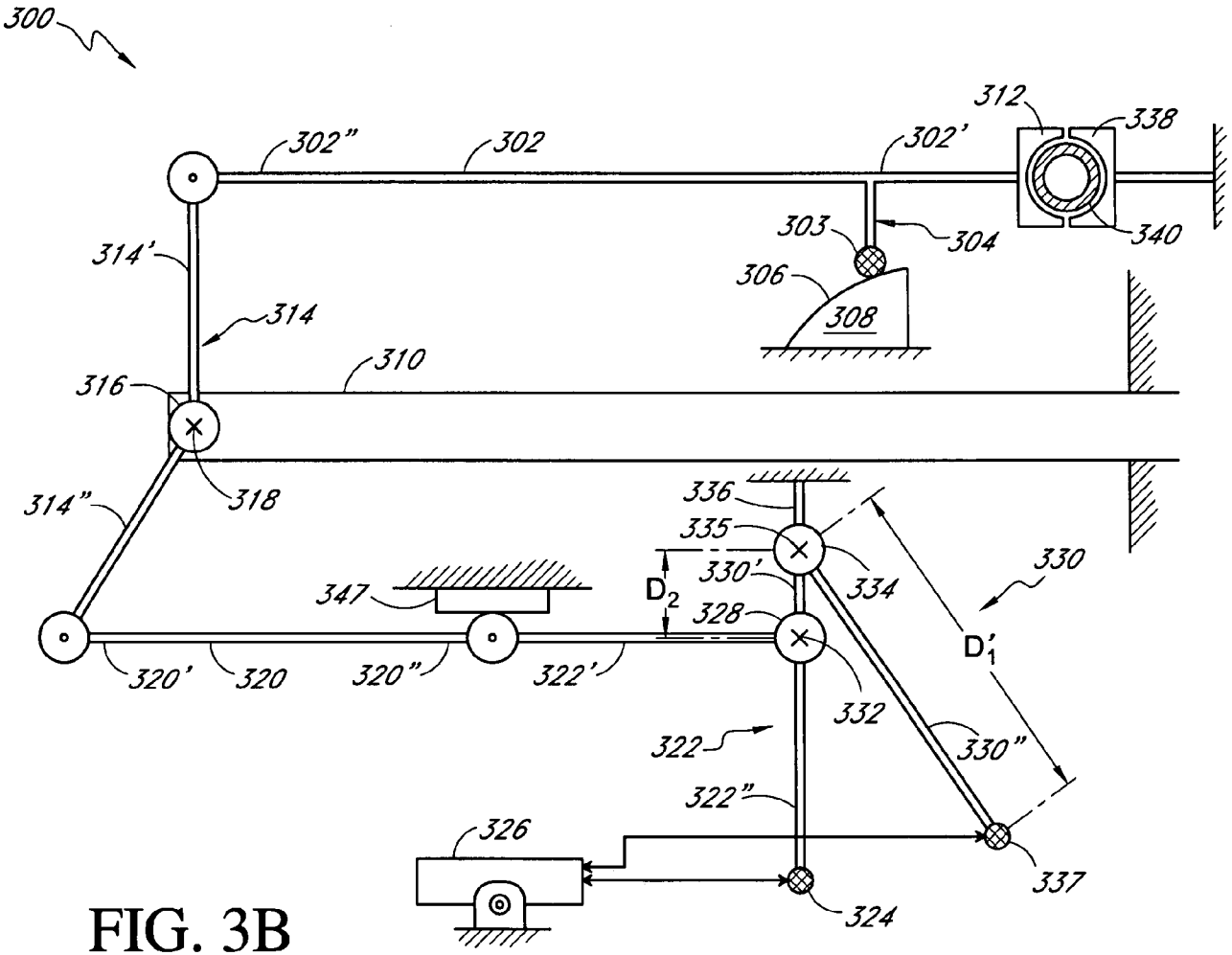
FIG. 3B shows the clamping assembly of FIG. 3A in its closed position.

FIG. 3C is a diagram of another exemplary arrangement for obtaining the force multiplication provided by the lever 330 of FIG. 3A. In FIG. 3B, the force multiplication is obtained by pivotally coupling a single-arm lever 330B to a support and pivot member 336B characterized by an axis 335B. A pivot member 328B having an axis 332B can be fixedly coupled to the lever 330B. The drive link 322 (not shown in FIG. 3B) pivotally couples to the pivot member 328B. When the actuator 326 pulls the member 337B at the lever second end 330B", the drive link 322 rotates clockwise about the axis 335B, thereby pushing the drive link first end 322' to press against the toggle link 320. This configuration corresponds to a second class lever (i.e., where the load is between the fulcrum and the effort). In this case, the effort arm is the distance D1' between the axis 335B and the line of action of the force provided by the actuator 326 at the member 337B. The load arm is the distance D2' between the axis 335B and the axis 332B. The force multiplication is the ratio of the lever arm to the load arm, namely D1':D2'.

The person of ordinary skill in the art will readily recognize that the actuator 326 may be replaced by, for example, two separate actuators. One of the actuators can be a low force actuator that acts upon the drive link 322 to raise or lower the slider 302. The second actuator can be a high force actuator that acts upon the lever 330 to provide a high, controlled and variable clamping force at the clamp die 312. Below a clamping system using a single actuator is described with reference to FIGS. 4 through 15.

Additionally, it will be apparent to an ordinary technician that the couplings of the various components of the clamping assembly 300 can take numerous forms. For example, the pivot member 316 can be coupled to the bend arm 310 with suitable fasteners such as bolts, or with a weld, or by a press fit into a bore integral to the bend arm 310. Moreover, by way of example, the pivot coupling of the lever 314 at the pivot member 316 may take the form of a gear mechanism that transmits the force from the lever second end 314" to the lever first end 314'. Additionally, the couplings between the lever 314, toggle link 320, and drive link 322 may be, for example, pivot pins that allow pivoting motion of the lever 314, toggle link 320, and drive link 322 at the coupling points.

The dimensions and materials of the various components of the clamping assembly 300 are chosen to suit the specific application. The dimensions of an exemplary embodiment are provided below with reference to FIGS. 4 through 21B. Generally, the linkages can be made of metallic materials having suitable strength and durability. Specific materials are referenced in the description of exemplary components shown in FIGS. 14 through 21B.

Figure 4:
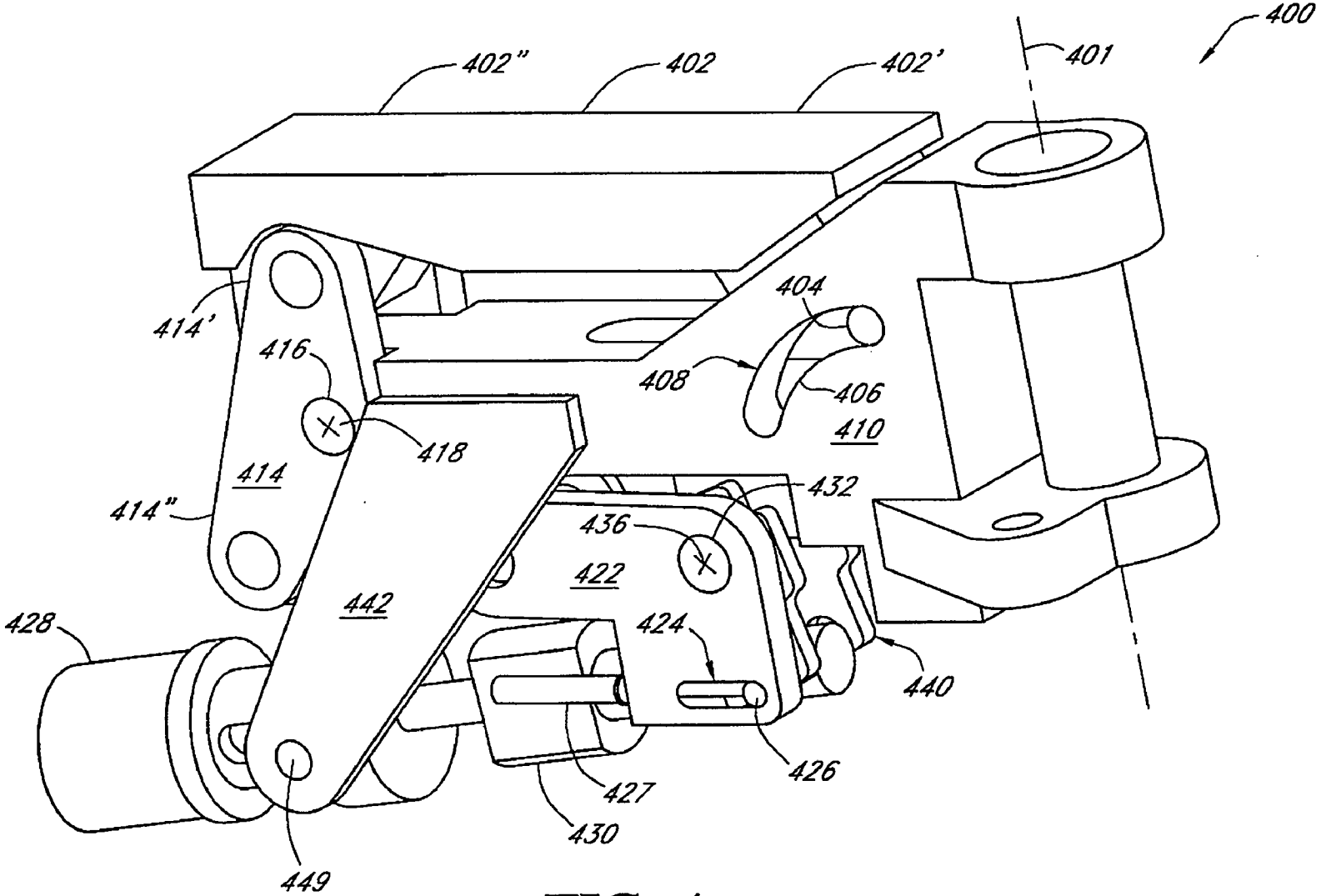
FIG. 4 is a perspective view of a clamping assembly and bend arm in accordance with one embodiment of the invention.
Figure 5:
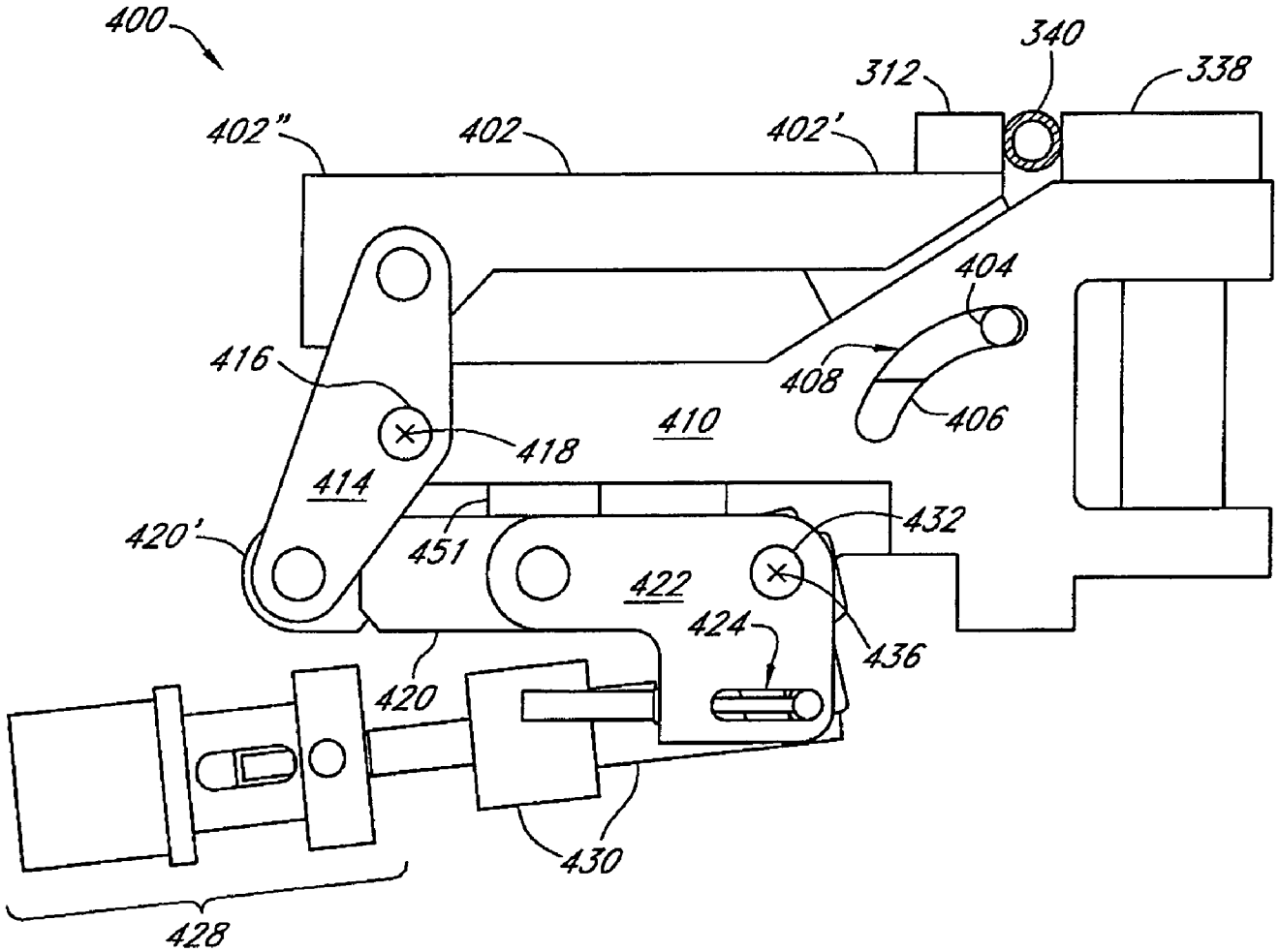
FIG. 5 is a side elevational view of the clamping assembly shown in FIG. 4, except that certain components of the clamping assembly are removed in order to more clearly show other components.

Another embodiment of the clamping assembly of the invention will be described with reference to FIGS. 4 through 15. Referring to FIGS. 4 and 5, the clamping assembly 400 includes a bend arm slider 402 having a first end 402' and a second end 402". The slider 402 couples to a peg 404 that moves along an arcuate surface 406, which is provided by a guide slot 408 that is integral to the body of a bend arm 410. The slider first end 402' is configured to receive a clamp die 312. The slider second end 402" is pivotally coupled to a lever 414 at a lever first end 414'. The lever first end 414' and lever second end 414" pivot about a pivot member 416 that is coupled to the bend arm 410. The pivot member 416 is characterized by an axis 418 that also defines a pivot axis for the lever 414. In this embodiment, two levers 414 are provided such that there is one lever 414 for each lateral side of the slider second end 402", wherein a bar connects the two levers 414 (see FIG. 16). The configuration of the two levers 414 provides stability and added strength to the clamping assembly 400. A first end 420' of a toggle link 420 couples pivotally to the lever second end 414".

The toggle second end 420" couples pivotally to a first end 422' of a drive link 422. A drive link second end 422" includes a guide slot 424 that receives and guides a push rod 426 (see FIG. 4). A support plate 442 couples to the bend arm 410 and supports a pivot member 449, which couples pivotally to an actuator 428. A stop member 451 couples to the bend arm 410 and serves to prevent upward motion of the toggle link 420 and drive link 422 at their coupling point.

Figure 6A:
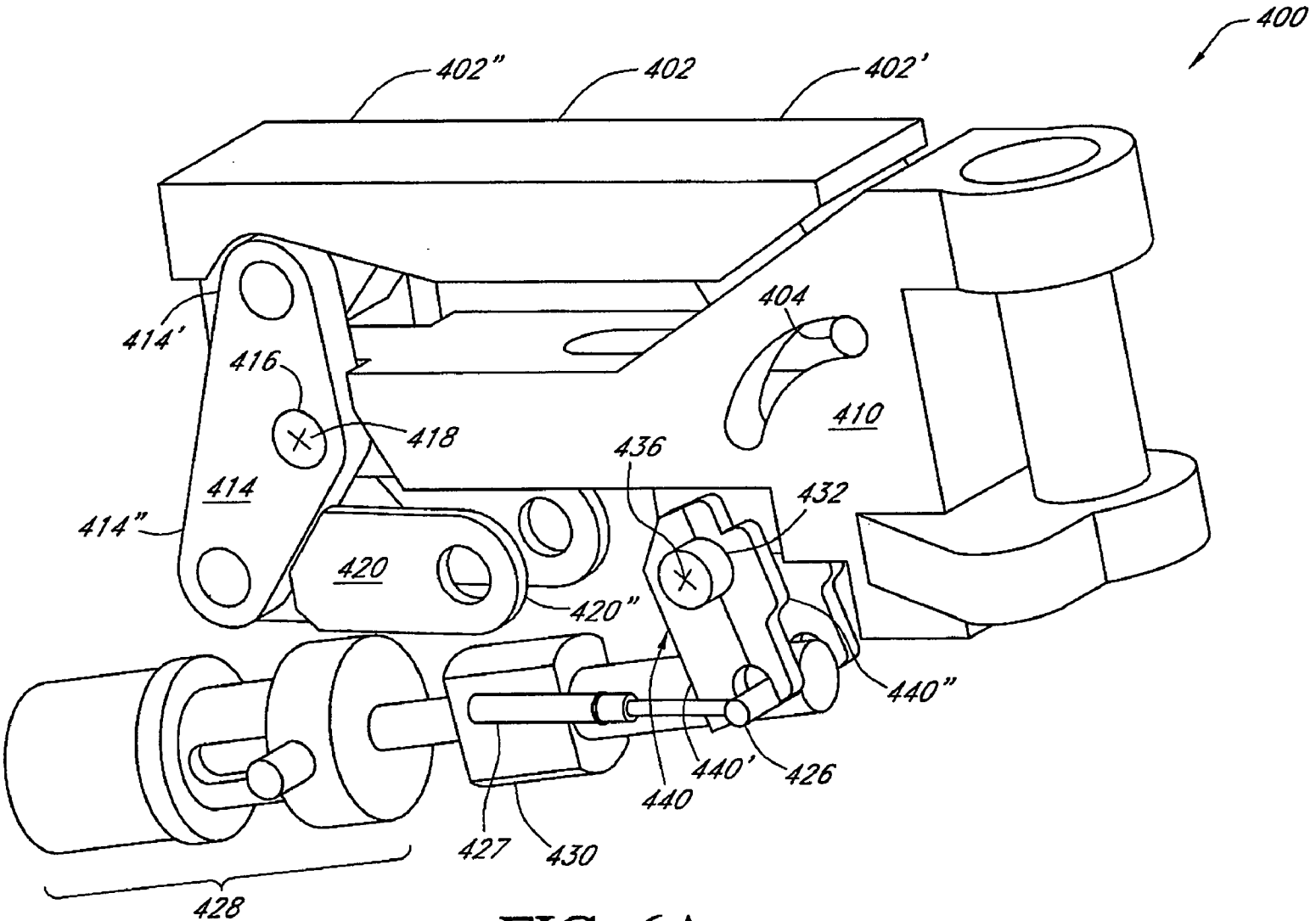
FIG. 6A is a perspective view of the clamping assembly of FIG. 4, except that certain components of the clamping assembly are removed in order to more clearly show other components.
Figure 6B:
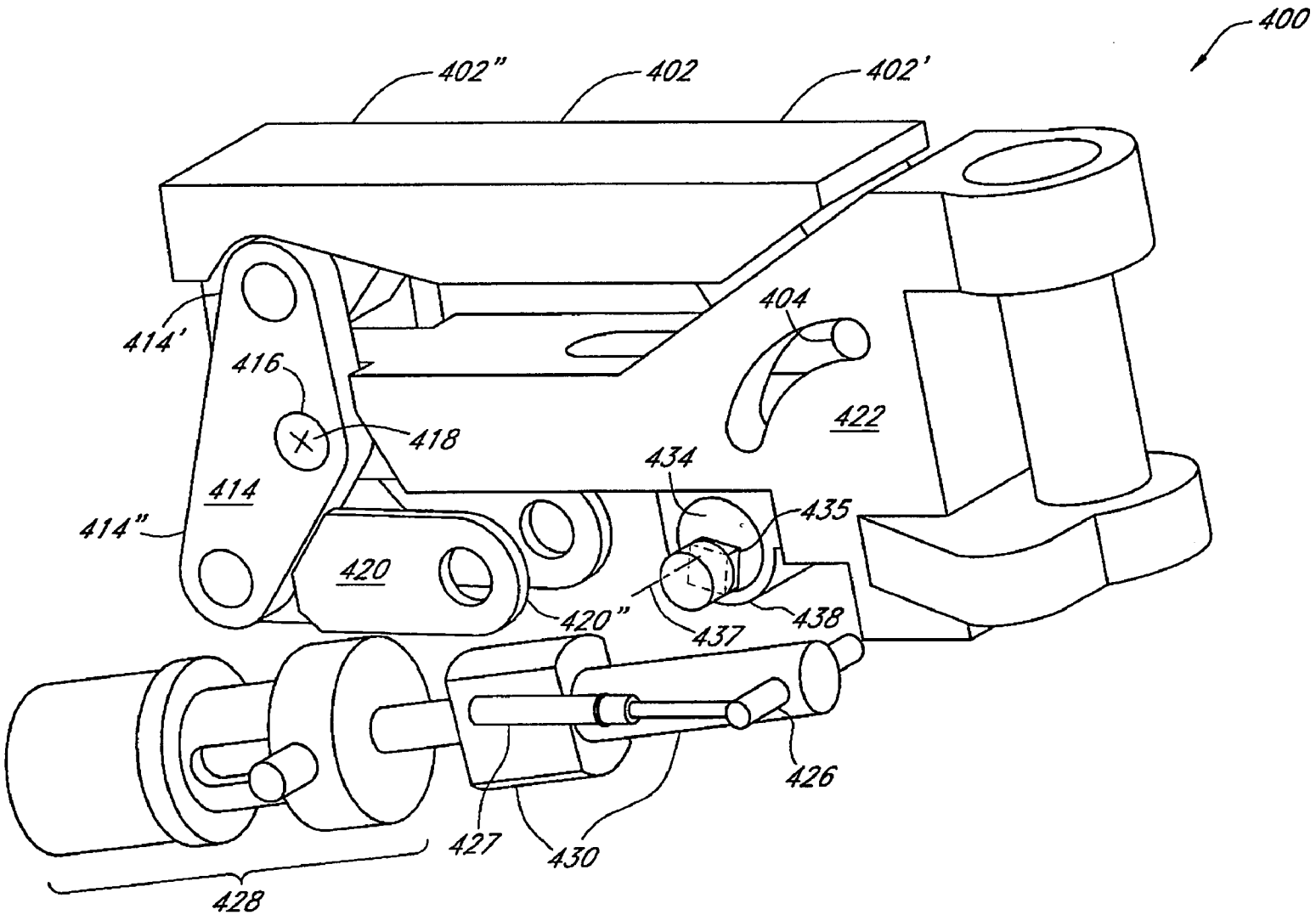
FIG. 6B is a perspective view of the clamping assembly of FIG. 6A, except that certain components of the clamping assembly are removed in order to more clearly show other components.
Figure 7:
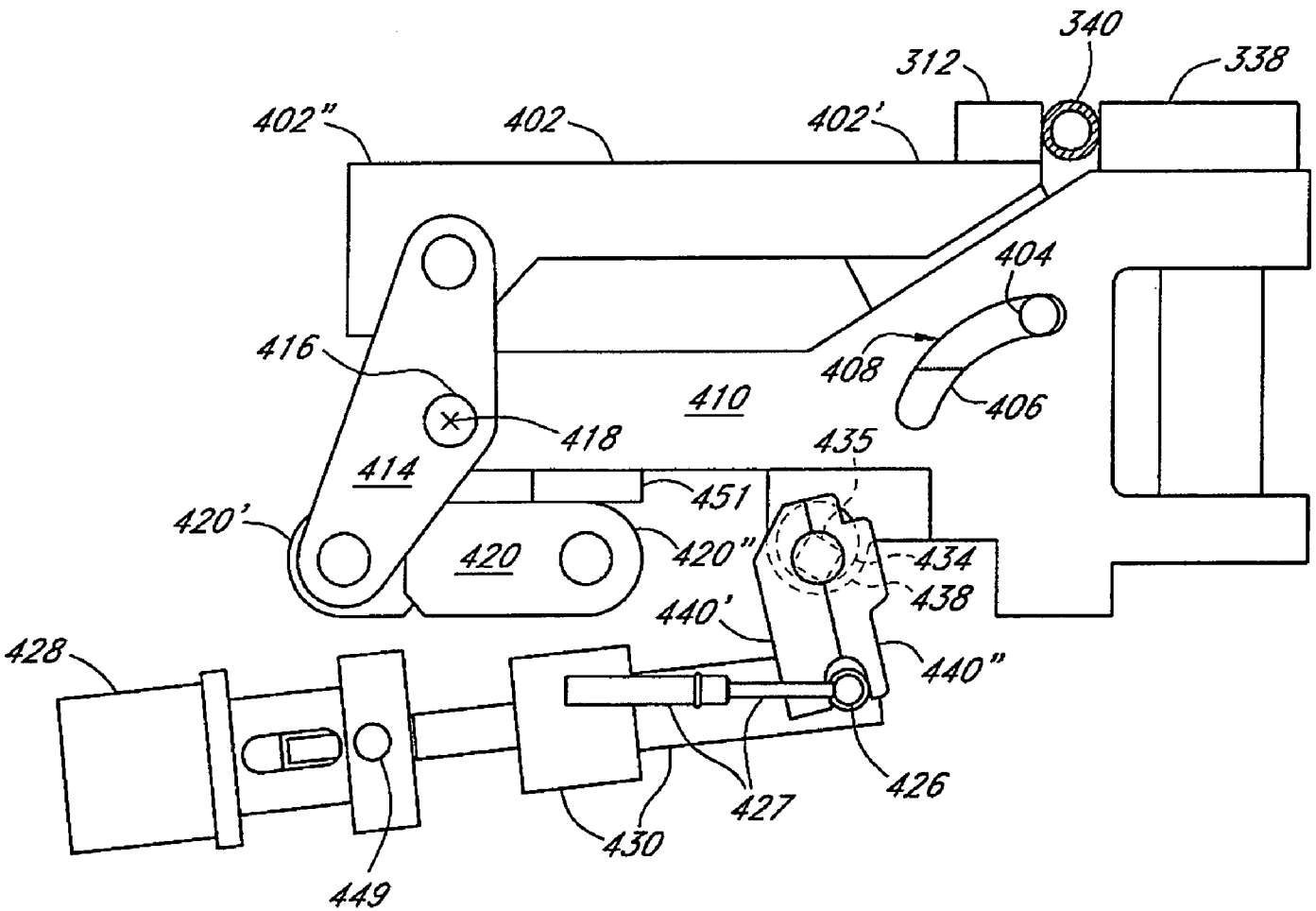
FIG. 7 is a side elevational view of the components shown in FIGS. 6A and 6B.

Referencing FIGS. 6A, 6B, and 7, the push rod 426 couples to a motor 428 through a lead screw mechanism 430. The drive link 422 (see FIG. 5) couples pivotally to a pivot member 432 configured to pivot about an axis 436 of the pivot member 432. The pivot member 432 couples to a bearing member 434 through a connecting member 435. The bearing member 434 is configured to pivot about a central axis 437 and is supported on a bearing block 438. A force multiplier arm 440, having a first arm 440' and a second arm 440", couples to the connecting member 435 at one end and couples to the motor 428 at the other end. In this embodiment, the coupling between the force multiplier arm 440 and the motor 428 is the lead screw mechanism 430 and the push rod 426.

Figure 8:
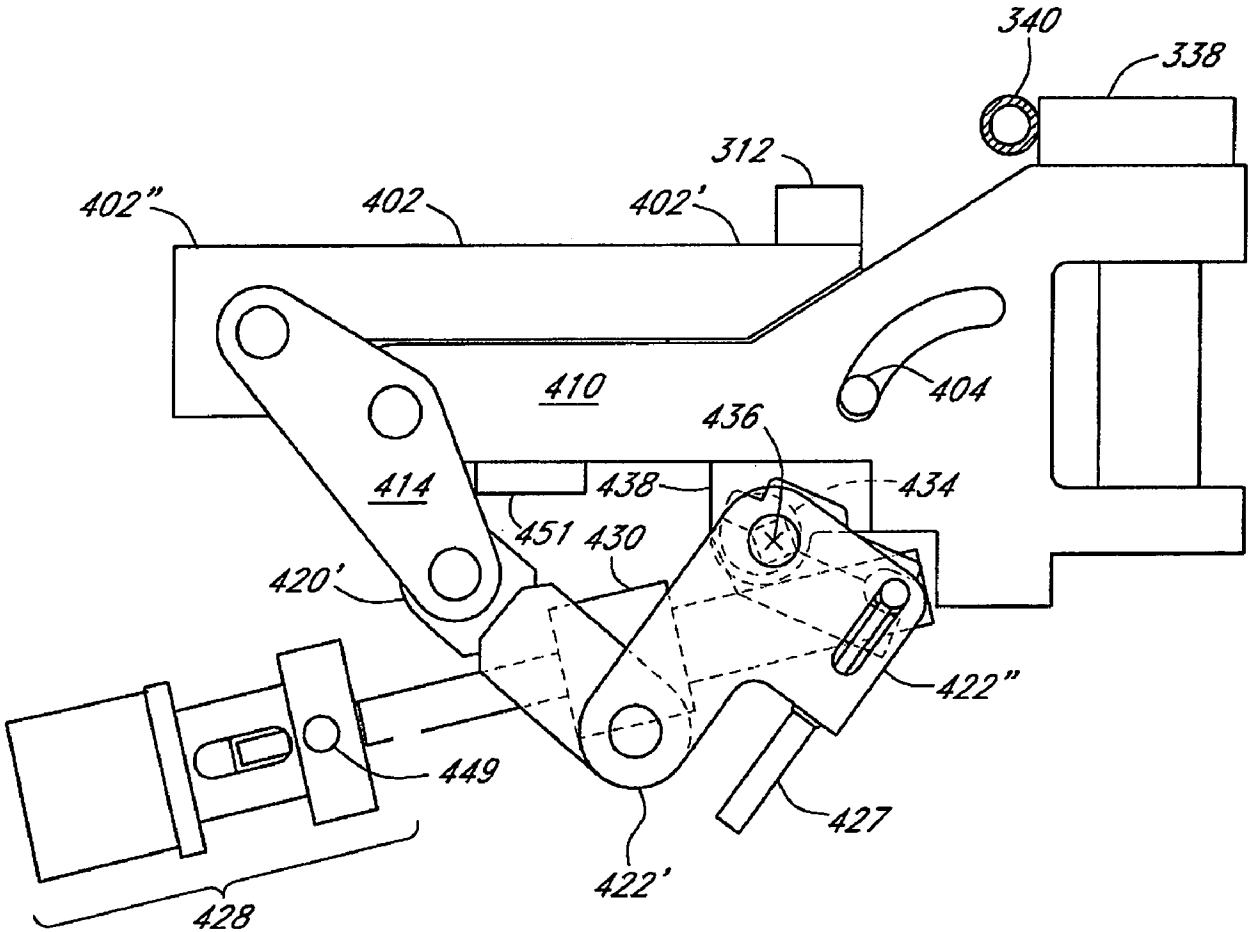
FIG. 8 is a side elevational view of the clamping assembly shown in FIG. 4, with the bend arm slider of the clamping assembly shown in its retracted and lowered position.

The operation of the clamping assembly 400 will now be described with reference to FIGS. 8 through 13. Starting at an open position as shown in FIG. 8, in which the clamp die 312 is retracted and lowered relative to a bend die 338, the motor 428 acts on the lead screw mechanism 430 to pull the push rod 426, thereby pivoting the drive link 422 clockwise about the axis 436 (see FIGS. 9 and 10). The retaining member 427 keeps the push rod 426 pressed against one end of the guide slot 424, as shown in FIGS. 9–11. The drive link first end 422' acts upon the toggle second end 420", which results in a lifting of the toggle second end 420" as well as a simultaneous pivoting of the toggle second end 420" about the coupling of the toggle first end 420' and the lever second end 414".

Figures 12A, 12B:
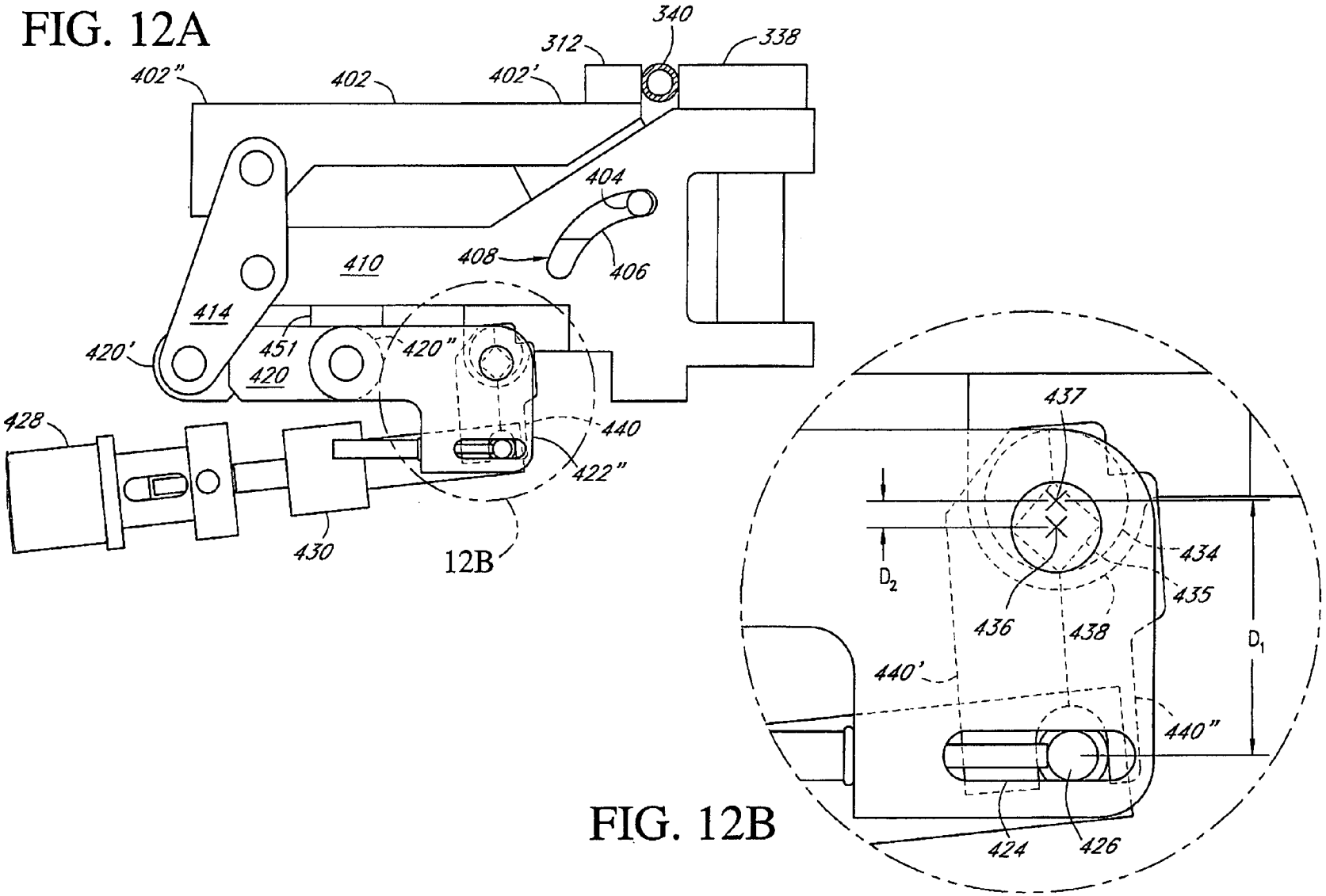
FIG. 12A is a side elevational view of the clamping assembly of FIG. 11, except that the linkage assembly is illustrated as having completely raised and extended the slider from its retracted and lowered position shown in FIG. 8.
FIG. 12B shows the relationship of the force multiplier arm and a bearing member in accordance with one embodiment of the clamping assembly illustrated in FIG. 12A.

The toggle first end 420' pushes against the lever second end 414" causing the lever 414 to pivot clockwise about the axis 418 (see FIGS. 9 and 10). The lever first end 414' pushes against the slider second end 402", thereby causing the slider 402 to extend toward the bend die 338 as the peg 404 rides up the arcuate surface 406 (see FIGS. 9–11). As shown in FIGS. 9 through 12A, this movement continues until the longitudinal axis of the toggle link 420 comes into collinear alignment with the longitudinal axis of the drive link first end 422'. The stop member 451 prevents any further upward movement of the toggle link 420 and drive link 422 at their coupling point; in effect, the toggle link 420 and the drive link end 422' become a rigid bar that transmits a force from the pivot member 432 to the lever 414. At the end of the movement, as illustrated in FIG. 12A, the slider 402 brings the clamp die 312 into abutting engagement with the workpiece 340. Hence, the combined action of the drive link 422, toggle link 420, and lever 414 raises and extends the slider 402 from a retracted and lowered position (see FIG. 8), as the motor 428 acts through the lead screw mechanism 430 on the push rod 426 to pivot the drive link 422 clockwise about the axis 436.

A retaining member 427 keeps the push rod 426 pressed against one end of the guide slot 424 during the raising and extending of the slider 402. The interaction between the push rod 426 and the drive link second end 422" results in the raising of the toggle link 420. However, once the slider 402 is raised and extended into engagement with the workpiece 430, the motor 428 and lead screw mechanism 430 overcome the resistance of the retaining member 427 and pull the push rod 426 into engagement with the first arm 440' of the force multiplier arm 440. Through this coupling, the motor 428 applies a controlled and variable force against the workpiece 340, as the force is transmitted to the workpiece 340 via the drive link 422, toggle link 420, lever 414, slider 402 and clamp die 312. In one embodiment, the motor 428 is an electric servo motor that can be programmed to provide a certain level of torque to the lead screw mechanism 430. Once programmed, the motor 428 will pull the push rod 426 against the force multiplier arm 440 to maintain the desired torque level.

Figure 13:
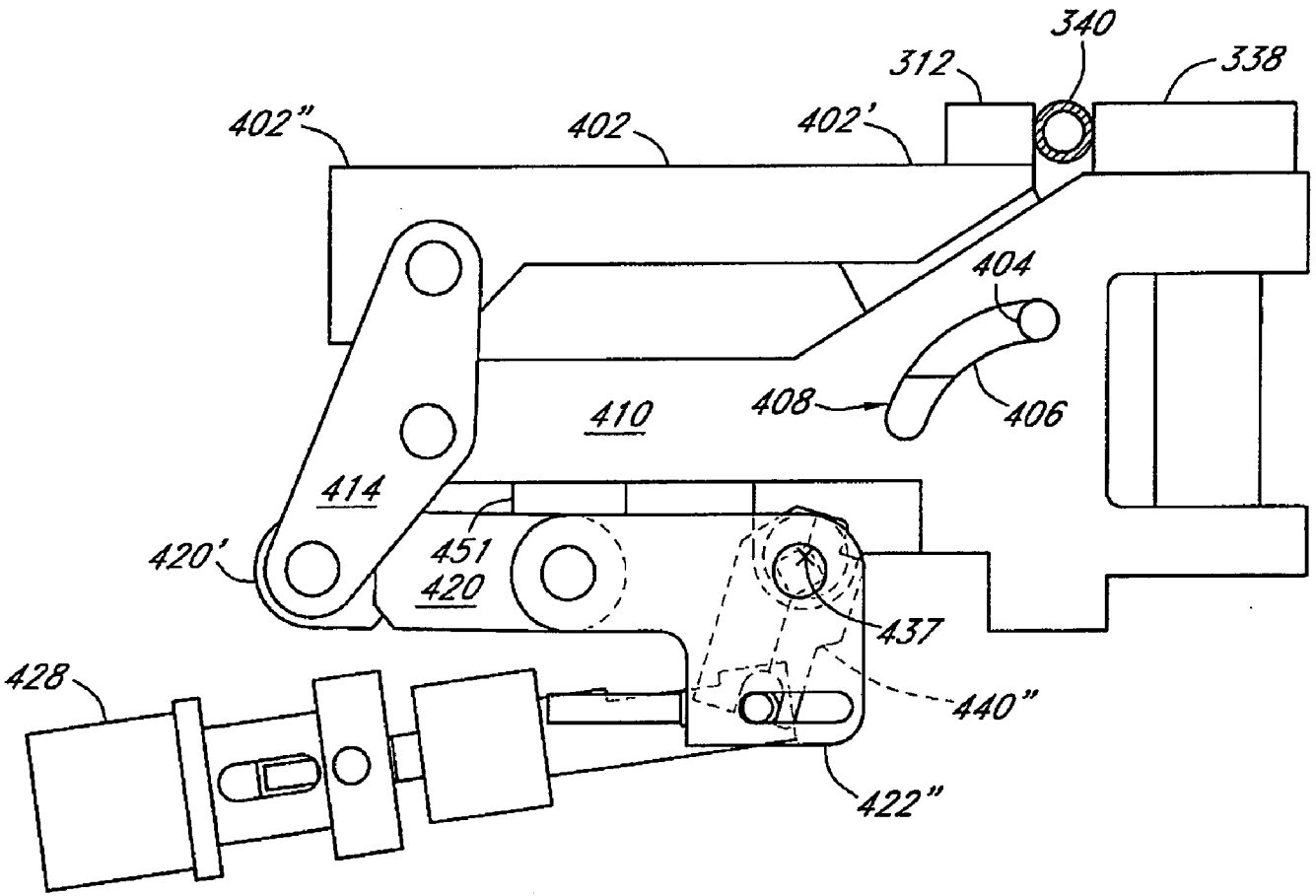
FIG. 13 is a side elevational view of the clamping assembly of FIG. 12A, except that the actuator is illustrated as having pulled a force multiplier arm to apply a pressure at a clamp die of the clamping assembly.

That is, the motor 428 pulls the push rod 426 against the first end 440' of the force multiplier arm 440 causing the bearing member 434 to pivot clockwise about the axis 437 (see FIG. 13). Since the pivot member 432 is fixedly attached to the bearing member 434 through the connecting member 435, the pivoting of the bearing member 434 about the axis 437 results in the rotation of the pivot member 432 about the axis 437. The rotation of the pivot member 432 causes the drive link 422 to push against the toggle link 420, which in turn presses against the lever second end 414". The lever 414 thus is forced into a further clockwise movement about the axis 418, which results in the lever 414 pushing the slider 402 and clamp die 312 with high force against the workpiece 340.

When the lead screw mechanism 340 moves the push rod 426 against the second arm 440" of the force multiplier arm 440, the movement described above is reversed and the slider 402 releases the pressure on the workpiece 340. The retaining member 427 once again presses the push rod 426 against the end of the guide slot 424 to bring the push rod 426 into correct position for a subsequent operation of the clamping assembly 400.

To return the slider 402 from the raised and extended position to the retracted and lowered position, the motor 428 acts through the lead screw mechanism 430 on the push rod 426 to pivot the drive link 422 counterclockwise about the axis 436. The drive link first end 422' pushes the toggle second end 420" downward, and simultaneously the toggle first end 420' pivots about its coupling to the lever second end 414". The toggle first end 420' pulls on the lever second end 414" causing the lever 414 to pivot counterclockwise about the axis 418. As the lever first end 414' pivots about the axis 418, the lever first end 414' pulls the slider 402 away from the bend die 338. The slider 402 rides downward on the arcuate surface 406 with the aid of the peg 404 and the slot guide 408. Thus, the combined action of the drive link 422, toggle link 420, and lever 414 retracts and lowers the slider 402 from an extended and raised position as the motor 428 and lead screw mechanism 430 drive the push rod 426 to pivot the drive link 422 counterclockwise about the axis 436.

An advantage of the clamping assembly 400 is the magnification of a force that the motor 428 generates. The use of the force multiplier arm 440, as well as the attachment of the pivot member 432 to the bearing member 434 at a location (axis 436) offset from the axis 437 of the bearing member 434, result in a lever mechanism that amplifies the force that the motor 428 provides and that is ultimately transferred to the workpiece 340 by the linkage assembly described above. Referencing FIG. 12B, in this embodiment the "effort arm" is the distance D1 between the line of action of the force applied by the motor 428 to the first arm 440' of the force multiplier arm 440 (through the push rod 426) and the pivot axis 437. The "load arm" is the distance D2 between the pivot axis 436 and the pivot axis 437. The force magnification is substantially equal to the ratio of the effective lever arm to the load arm, namely D1:D2. In one embodiment the ratio is 2:1, more preferably 5:1, and most preferably at least 10:1. As will be further described below, in one embodiment D1 is about 2.5 and D2 is about 0.25, resulting in a ratio of 10:1.

In one embodiment, the connecting member 435 and force multiplier arm 440 are configured to couple to the bearing member 434 such that the force multiplier arm 440 is positioned at a slight angle, as shown in FIG. 12B, when the slider 402 is at the top of the movement. This position of the force multiplier arm 440 allows for continued application of a controlled force to a workpiece 340 in situations where, for example, the clamp die 312 and bend die 338 compress the workpiece 340. As the workpiece 340 is compressed, the push rod 426 can continue to press against the force multiplier arm 440, thereby causing the force multiplier arm 440 to continue pivoting about the axis 437. That is, one of the functions of the guide slot 424 and the angled position of the force multiplier arm 440 is to provide for a space and for movement such that the force multiplier arm 440 can effectively apply a constant force to a workpiece 340 even in situations where there is compression or slippage at the workpiece 340.

In one embodiment, the bend arm 410 has a length of about 14 inches from the axis 418 to an axis 401 (see FIG. 4) about which the bend arm 410 pivots. The width of the bend arm 410 is three inches, and the height of the bend arm is about 6.8 inches at one end. The guide slot 408 is about 0.75" inches wide, exhibits a radius of about 2.5" inches, and spans an arc of about 67 degrees. A suitable material for the bend arm 410 is cast iron.

In one embodiment, the slider 402 is about 14.5" inches in length, 3" in width, and 2.75 in height. As previously discussed, the slider 402 is configured to receive a clamp die 312, to couple to the lever 414, and to ride on the guide slot 408. Hence, one end of the slider 402 may comprise grooves (not shown) or other means for retaining the clamp die 312. In the embodiment shown in FIG. 15, the other end of the slider 402 includes a through bore for receiving a pivot pin that couples the slider second end 402" to the lever first end 414'. Additionally, the slider 402 can be provided with a peg 404 for engagement with the guide slot 408. A suitable material for the slider 402 is cast iron.

Figure 15:
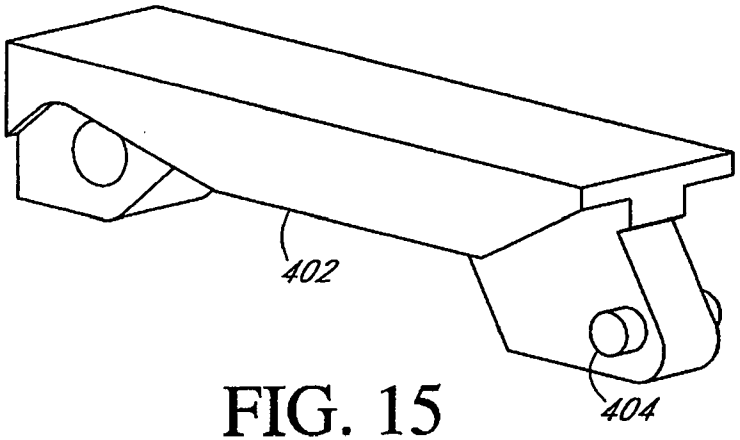
Figure 17:
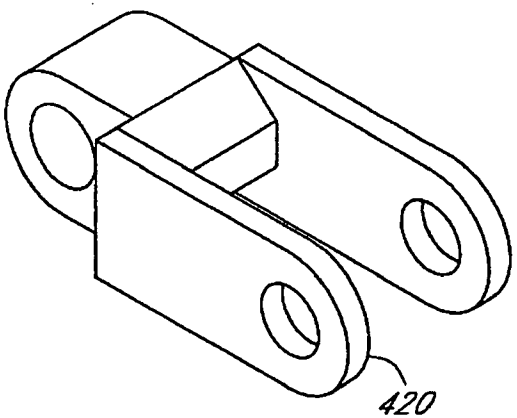
Figure 14:
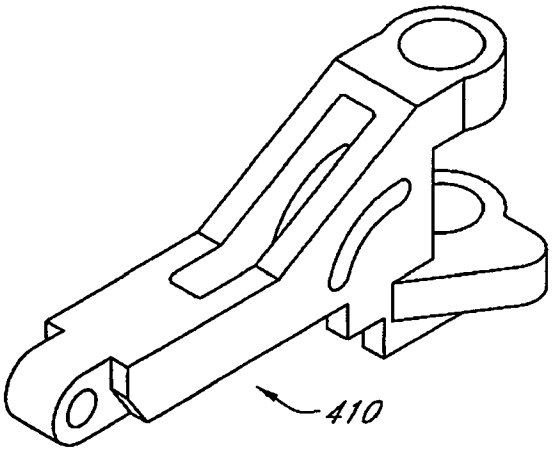
Figure 16:
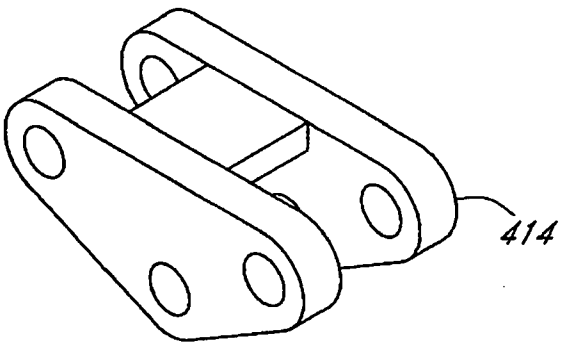

In one embodiment, the lever 414 consists of a plate having three through bores spaced in a triangular configuration (see FIG. 15). Two sides of the triangle are each about 2.6 inches in length (forming an angle of 135 degrees), and the third side is about 4.7 inches in length. Additional material can be provided (as shown in FIG. 4, for example) for increased strength and stability. The material for the lever 414 can be mild steel.

The toggle link 420 is about 5.5 inches long. The toggle link 420 has two through bores of about 1-inch diameter for receiving pivot pins (not shown) that couple the toggle first end 420' to the lever second end 414" and the toggle second end 420' to the drive link first end 422'. In this embodiment, the toggle link 420 has two arms at the toggle link second end 420" (see FIG. 15), wherein each arm couples to a drive link 422. The toggle link first end 420' comprises a through bore that couples to the two levers 414 with the aid of a pivot pin (not shown). The material for this piece can be an alloy steel such as 4130 HT Rc 28–32.

The drive link first end 422' is configured with a 1-inch diameter bore for receiving a pivot pin that couples the drive link first end 422' to the toggle second end 420". The height of the drive link 422 is about 3.8 inches, its length is about 7 inches, and its width is about 0.6 inches. The drive link 422 also includes a 1-inch diameter through bore for receiving the pivot member 432. The drive link 422 additionally includes a guide slot 424 having a half-inch width and a 2-inch length. The slot 424 spans the width of the drive link 422. The drive link can be made of a steel alloy such as 4130 HT Rc 28–32.

In one embodiment, the pivot member 432, connecting member 437 and bearing member 434 are machined to be a single piece as shown in FIG. 15. The bearing member is a solid cylinder having about a 1.5-inch diameter and a height of about 1.25 inches. The pivot member 432 is a solid cylinder of about 1-inch diameter and about 0.6 inches in height. In this embodiment the connecting member 437 consists of a rectangular box having square sides of about 0.7 inches and a height of about 0.4 inches. The pivot member 432 and connecting member 437 are machined on the flat sides of the bearing member 434 such that the principal axis 436 of the pivot member 434 is offset from the principal axis 437 of the pivot member by about 0.25 inches. The material for this component can be a heat treated steel alloy such as 4130 HT Rc 28–32.

The bearing block 438 has a width of about 3 inches, a height of about 2.25 inches, and a length of about 3 inches. The bearing block 438 is configured with a through bore that spans the width of the bearing block 438, the bore having a diameter of about 1.5 inches for receiving the bearing member 434. The bearing block 438 can be made of a steel alloy such as 4130 HT Rc 28–32. It is noted that since the bore of the bearing block 438 is configured for receiving the bearing member 434, selection of the materials for these two components should take into consideration the friction between the bearing member 434 and the bore of the bearing block 438. In some embodiments, during operation of the clamp assembly 400 the interface between the bearing member 434 and the bearing block 438 is lubricated with a suitable lubricant such as extreme pressure oil.

In one embodiment, the force multiplier arm 440 comprises a first arm 440' coupled to a second arm 440". The first arm 440' is about 3.5 inches long, 1.25 inches wide and 0.4 inches thick. One end of the first arm 440' is configured with a rectangular notch for engagement to the connecting member 435. The other end of the first arm 440' is configured with a space for receiving the push rod 426. The second arm 440" is 3.5 long, 1-inch wide and 0.4 inches thick. One end of the second arm 440" is configured with a rectangular notch for engagement to the connecting member 435. The other end of the second arm 440" is configured with a space for receiving the push rod 426.

When coupled together, the first arm 440' and the second arm 440" clamp onto the connecting member 435 and provide the structure by which the push rod 426 can transfer the force from the motor 428 and lead screw mechanism 430 to the bearing member 434, which then transmits the force to the drive link 422 via the connecting member 435 and the pivot member 432.

In one embodiment, the actuator 326 or motor 428 can be an electric servo motor such as a 3-phase, Sigma II servo, model 15D-A61, available from Yaskawa Electric America of Waukegan, Ill., U.S.A. This motor provides for controlling the torque output at least in the range of 10% to 100%. The lead screw mechanism 430 can be, for example, a unit sold by Applied International Motion of Layerne, Calif., U.S.A., under the brand name Rexroth Bolt Screw. The retaining member 427 can be a spring loaded mechanism such as a gas spring sold by Moeller Electric Company.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A clamping assembly for a bend arm of a tube bending machine, the clamping assembly comprising:

a bend arm slider having a first end and a second end, the slider first end configured to receive a clamp die, the slider coupled to a guide member configured to move along an arcuate surface of a camming member coupled to the bend arm;

a first lever having a first end and a second end, the first lever having a pivot axis and coupled to a first pivot member, the first pivot member coupled to the bend arm, and the first lever first end coupled to the slider second end and configured to drive the slider along the arcuate surface;

a toggle link having a first end and a second end, the toggle link first end coupled to the first lever second end, the toggle link configured to rotate the first lever about the first lever pivot axis;

a drive link having a first end and a second end, the drive link first end coupled to the toggle link second end, the drive link configured to drive the toggle link;

a second pivot member coupled to the drive link such that the drive link pivots about a second pivot member axis;

a bearing member coupled to the bend arm and having a bearing axis, the bearing member coupled to the second pivot member at a location offset from the bearing member axis;

an actuator coupled to the drive link second end and configured to rotate the drive link about the second pivot member axis such that a force is communicated from the actuator through the drive link, the toggle link, and the first lever to thereby cause the slider to retract or extend along the arcuate surface in response to the force;

a second lever having a first end and a second end, the second lever first end pivotally coupled to the bearing member and fixedly attached to the second pivot member; and wherein the actuator is coupled to the second lever second end and configured to actuate the second lever so as to rotate the bearing member about the bearing axis thereby communicating a force via the drive link, the toggle link, and the first lever to the slider, resulting in the transmission of a controlled, variable force from the actuator to the clamp die.

2. The clamping assembly of claim 1, further comprising a rod coupling the actuator to the drive link, the rod configured to engage with and to rotate the drive link about the second pivot member, the rod further configured to engage with and drive the force multiplier arm thereby causing the force multiplier arm first end to rotate the bearing member about the bearing member axis thereby moving the drive link toward or away from the toggle link in response to the force.

3. The clamping assembly of claim 1, wherein a guide slot of the bend arm defines the camming surface.

4. The clamping assembly of claim 1, further comprising a bearing block configured to receive and support the bearing member.

5. The clamping assembly of claim 1, wherein the actuator is an electric motor.

6. The clamping assembly of claim 2, further comprising a guide slot for guiding the rod.

7. The clamping assembly of claim 6, wherein the guide slot is part of the drive link.

8. The clamping assembly of claim 1, wherein the coupling of the actuator to the drive link and to the second lever comprises a lead screw mechanism.

9. A clamping assembly for a tube bending machine, the clamping assembly comprising:

a bend arm slider configured to receive a clamp die;

a linkage assembly including at least one linkage member, the linkage assembly configured to move the bend arm slider;

a pivot member coupled to the linkage member such that a portion of the linkage member pivots about an axis of the pivot member;

a bearing member having an axis, the bearing member coupled to the pivot member at a location offset from the bearing member axis; and a lever attached to the bearing member and configured to rotate the bearing member about the bearing member axis.

10. The clamping assembly of claim 9, further comprising an actuator coupled to the linkage member so as to cause the linkage member to rotate about the pivot member axis.

11. The clamping assembly of claim 10, wherein the actuator is further coupled to the lever so as to cause the lever to rotate the bearing member about the bearing member axis.

12. The clamping assembly of claim 11, further comprising a lead screw mechanism for coupling the actuator to the linkage member and to the lever.

13. The clamping assembly of claim 12, wherein the actuator is coupled to the linkage member and to the lever such that the lead screw mechanism causes the rotations of the linkage member and the bearing member during of one continuous movement of the lead screw.

14. The clamping assembly of claim 13, wherein the coupling of the actuator to the linkage member and to the lever is such that the rotations of the linkage member and the bearing member are substantially sequential in time.

15. The clamping assembly of claim 13, wherein the actuator, lead screw, and linkage assembly are configured such that rotation of the lead screw in a first direction results in a raising and extending of the slider.

16. The clamping assembly of claim 14, wherein the actuator, lead screw, and linkage assembly are configured such that rotation of the lead screw in a second direction results in a lowering and retracting of the slider.

17. The clamping assembly of claim 15, wherein the actuator, lead screw, lever, and pivot member are configured such that a rotation of the lead screw in a first direction results in the rotation of the linkage member about the bearing member axis.

18. The clamping assembly of claim 9, wherein the linkage assembly, comprises a toggle link coupled to the linkage member.

19. The clamping assembly of claim 18, further comprising a stop member configured to provide a stop at a coupling of the toggle link and the linkage member.

20. The clamping assembly of claim 12, wherein the actuator is programmed to a exert a torque up to a preset limit on the lead screw mechanism such that lever is subject to a substantially constant force during clamping of a workpiece by the clamping assembly.

21. The clamping assembly of claim 10, wherein the linkage assembly comprises a lever having two arms, wherein a first arm of the lever is coupled to the toggle link and a second arm of the lever is coupled to the slider.

22. A clamping assembly for a bend arm of a tube bending machine, the clamping assembly comprising:

a bend arm slider configured to receive a clamp die and to move along a camming member;

a first class lever having first and second arms, the first arm of the first class lever coupled to the slider;

a toggle link coupled to the second arm of the first class lever and configured to actuate the first class lever;

a drive link configured to drive the toggle link;

a pivot member coupled to the drive link such that a portion of the drive link pivots about an axis of the pivot member;

a bearing member having a bearing member axis, the bearing member coupled to the pivot member at a location offset from the bearing member axis;

an actuator configured to rotate the drive link about the pivot member axis such that a force is communicated from the actuator through the drive link, connecting link, and first-class lever to thereby actuate the slider;

a lever arm coupled to the bearing member at the offset location such that the lever arm and the bearing member cooperate to form a second class lever; and wherein the actuator is configured to actuate the lever arm so as to rotate the bearing member about the bearing member axis resulting in the transmission of a force, via the drive link and the toggle link, from the actuator to the first class lever.

23. The clamping assembly of claim 22, wherein the first and second arms of the first class lever are of equal length.

24. The clamping assembly of claim 22, wherein the drive link comprises a first class lever.

25. The clamping assembly of claim 22, wherein the pivot member is fixedly attached to the bearing member.

26. The clamping assembly of claim 22, further comprising a bearing block having a space for receiving and supporting the bearing member.

27. The clamping assembly of claim 26, wherein the bearing member comprises a cylindrical body and the space for receiving and supporting comprises a cylindrical bore, and wherein the cylindrical body is configured to rotate within the cylindrical bore.

28. The clamping assembly of claim 22, further comprising a coupling between the actuator and the drive link, wherein said coupling comprises a lead screw mechanism.

29. The clamping assembly of claim 28, further comprising a coupling between the actuator and the lever arm, wherein said coupling comprises the lead screw mechanism.

30. A clamping assembly for a tube bending machine, the clamping assembly comprising:

linkage means for raising and extending or lowering and retracting a clamp die relative to a bend die of the tube bending machine;

a bearing member having a bearing member axis, the bearing member coupled to pivot means at a location offset from the bearing member axis;

lever means coupled to the bearing member at the offset location; and actuating means configured to actuate the lever arm so as to rotate the bearing member about the bearing member axis resulting in the transmission of a force via the linkage means from the actuating means to the clamp die.

31. The clamping assembly of claim 30, wherein the linkage means comprises a toggle link.

32. The clamping assembly of claim 30, wherein the bearing means comprises a cylindrical body and a bearing block, wherein the cylindrical body is configured to rotate inside a bore of the bearing block, and wherein the bearing block is configured for attachment to a bend arm of the tube bending machine.

33. The clamping assembly of claim 30, wherein the actuating means comprises an electrical motor.

34. The clamping assembly of claim 33, wherein the actuating means further comprises a lead screw mechanism.

35. The clamping assembly of claim 32, wherein at least part of the linkage means is pivotally coupled to the pivot means.

36. A bend head for a tube bending machine, the bend head comprising:

a bend arm configured to cooperate with a rotary bend die for bending a workpiece;

a linkage assembly coupled to the bend arm for positioning a clamp die, the clamp die configured to grip the workpiece in cooperation with the bend die;

a bearing member having a bearing member axis;

a bearing block configured to support the bearing member and to be coupled to the bend arm, wherein the bearing member is configured to rotate about the bearing member axis inside a bore of the bearing block;

a pivot member attached to the bearing member at a location offset from the bearing member axis; and a lever configured to rotate the bearing member about the bearing member axis, a first end of the lever attachable to the bearing member.

37. The bend head of claim 36, wherein the linkage assembly comprises a toggle link.

38. The bend head of claim 36, wherein the bearing member comprises a solid cylindrical body having a surface in contact with the bore of the bearing block.

39. The bend head of claim 36, wherein the bearing member axis and a line of action of a force applied by the actuator at the lever second end define a distance D2.

40. The bend head of claim 39, wherein the bearing member axis and the location offset from the bearing member axis define a distance D2.

41. The bend head of claim 40, wherein D1 is greater than D2 such that the force is magnified by a ratio substantially equal to D1:D2.

42. The bend head of claim 36, further comprising an actuator coupled to a second end of the lever to cause the lever to rotate the bearing member.

43. The bend head of claim 42, wherein the actuator is an electric motor.

* * * * *